United States Patent [19]

Sanchez Rubio

[11] Patent Number: 5,054,376

[45] Date of Patent: Oct. 8, 1991

[54] ELECTRIC CEILING FAN

[76] Inventor: Gines Sanchez Rubio, Zurbano, 84, Madrid, Spain, 28010

[21] Appl. No.: 433,776

[22] Filed: Nov. 9, 1989

[51] Int. Cl.[5] ..... F03D 5/06

[52] U.S. Cl. ..... 98/1; 416/79

[58] Field of Search ..... 98/1; 416/79, 80

[56] References Cited

U.S. PATENT DOCUMENTS

| | | | |
|---|---|---|---|
| 114,491 | 5/1871 | Thompson | 416/79 |
| 189,793 | 4/1877 | Schmidt | 416/80 |
| 198,798 | 1/1878 | Elkins et al. | 416/80 |
| 250,165 | 1/1894 | Carr | 416/80 |
| 526,929 | 10/1896 | Mackie | 416/80 X |
| 707,040 | 8/1902 | Warlick | 416/79 |
| 732,363 | 6/1903 | Marak | 416/79 |
| 753,687 | 3/1904 | Earl | 416/80 |
| 1,707,387 | 4/1929 | Cline | 416/80 |

*Primary Examiner*—William E. Tapolcai

*Attorney, Agent, or Firm*—Wenderoth, Lind & Ponack

[57] ABSTRACT

An assembly can be anchored on a ceiling or a beam and includes a motor, preferably electrical, and a velocity demultiplexer formed by pulleys or by gear systems which transmits the motor driving force to an arm or arms of a fan member which has an axis common with that of the outlet of the demultiplexer. The movement of the motor is controlled by an electronic circuit which emulates manual impulsion, taking advantage of the natural frequency of oscillation of the pendulum which is formed by the mass of the fan member when it is suspended from an axle.

5 Claims, 2 Drawing Sheets

ELECTRIC CEILING FAN

BACKGROUND OF THE INVENTION

The present invention relates to an electric ceiling fan which has advantages over those previously utilized.

As a reference to the prior state of the art, it should be noted that modern techniques generally have not been applied to the ancient system of achieving ventilation by hanging a fan from the ceiling in the manner of a pendulum, which was moved normally by the force of a slave or a servant, since greater efficacy and simplicity have been replaced by modern ventilators with revolving blades.

Therefore, the hold type ceiling ventilators have not progressed technically, and practically they continue to be used only in the Middle East, countries which they originated. Their impulsion is still manual, transmitting the necessary power by means of a cord or similar arrangement.

SUMMARY OF THE INVENTION

The device in this invention is intended to allow the world by driving it by means of electricity. For this the traditional manner of human impulsion is emulated, which takes advantage of the pendulum effect of the mass of the fan and in this way obtains, aside from a better expenditure of energy, a smooth and harmonic swinging motion.

As in manual operation, starting from a position of repose, the first time the motor tries to move the fan, it only does so slightly, but the second and successive times, the energy accumulated in the mass of the fan is added to that of the motor, which changes direction each time that the device so commands, until it reaches a maximum point of elevation.

Thus, the motor necessary to impel the fan may be of the smallest possible size, since less energy is required. For the same reason, a demultiplexing system necessary to optimize the force of the motor may be accomplished by belts or by a cord so that the level of noise produced is practically negligible.

BRIEF DESCRIPTION OF THE DRAWINGS

The following detailed description, with reference to the attached drawings, is by way of example and without any limiting nature of a preferred embodiment of the invention.

DETAILED DESCRIPTION OF THE INVENTION

Figure 1:
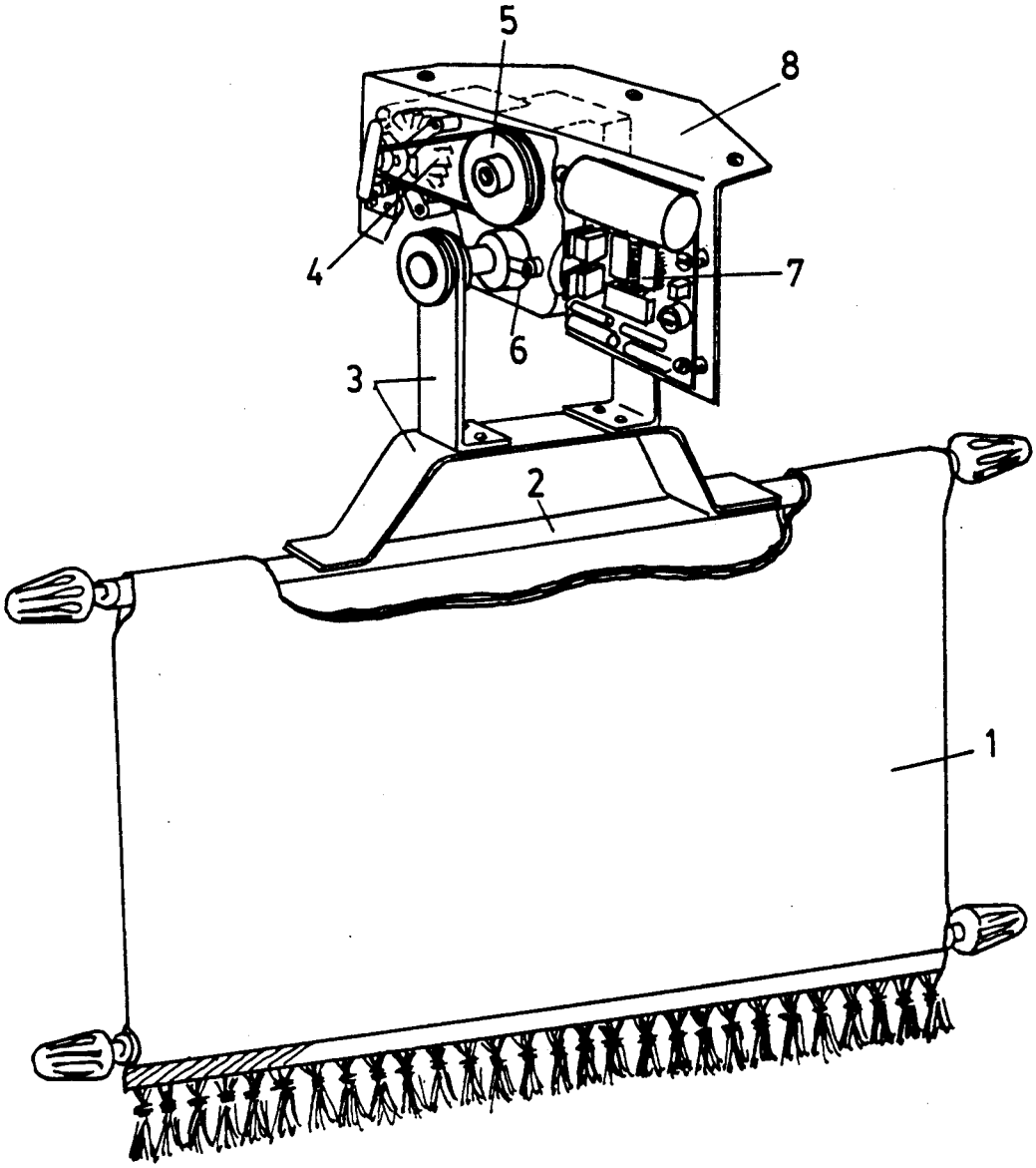
FIG. 1 is a perspective view of a preferred form of a fan according to the invention.

In FIG. 1 is shown a preferred form of a fan of the invention and including a planar or sheet fan member 1, either rigid or flexible, which is suspended from an oscillating axle 2 which is joined by means of arms 3 to a drive motor 4 by means of a mechanical reduction transmission through transmission pulleys or speed reduction gears 5 and 6. Swinging or oscillating movement of the fan member is controlled by means of an electronic circuit 7, to be described in greater detail below. All of the fan assembly and transmission elements are supported by bracket 8 which may be suspended from a ceiling of the premises to be conditioned.

Figure 2:
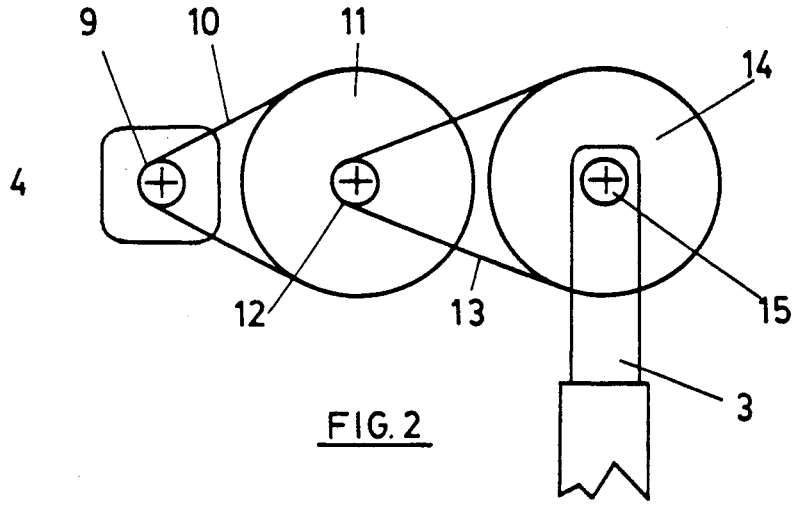
FIG. 2 is a schematic view of mechanical portions of the fan employing a double demultiplexer with pulleys.

FIG. 2 shows in schematic form an embodiment of the mechanical transmission of the fan. The motor 4 has an output shaft and a driving pulley 9 which by way of a belt 10 drives a pulley 11, which in turn has a pulley 12 attached to its axle. Pulley 12, by way of a belt 13, drives a pulley 14, to an axle 15 of which the arm or arms 3 supporting the fan member are solidly attached. These two reduction or demultiplexer assemblies, especially the second one which is the one which handles the most force (pulleys 12 and 14 as well as the linkage element therebetween, i.e. belt 13), may be of the toothed type to prevent them from sliding. In such manner, springs or gravity turnbuckles will not be necessary, thus avoiding losses of energy inherent in such structures. Also, such reduction assemblies may be formed by gear systems, even though, as already mentioned, it is advisable that at least the first assembly include pulleys to avoid the inescapable noise produced by a high speed pinion motor meshing with a toothed wheel.

Figure 3:
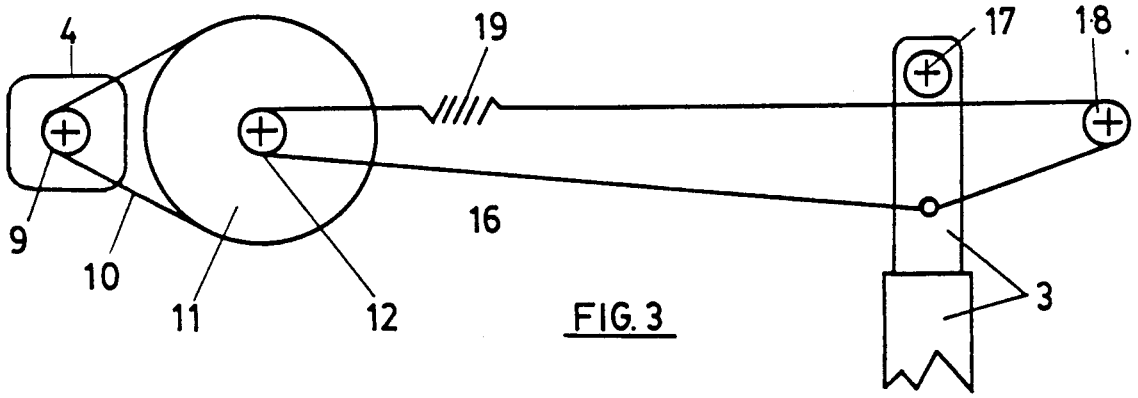
FIG. 3 is a similar view of a variant employing a single step pulley demultiplexer and impulsion by means of cords.

In FIG. 3, another preferred embodiment of the transmission includes the motor 4 and a single reduction or demultiplexer assembly formed by the pulleys 9 and 11, as well as the belt 10, similar to the arrangement in FIG. 2. Attached to the axle of the pulley 11 is a cylinder 12 around which are would plural loops of a cord 16. Cord 16 transmits movement to the arm 3 of the fan member which is suspended from an axle 17 anchored in the ceiling. So that the motor may provide energy in both directions and in this way impart symmetrical displacement, the cord 16 runs over a pulley 18 and includes an elastic turnbuckle or spring 19, which can absorb differences of length of the development.

Figure 4:
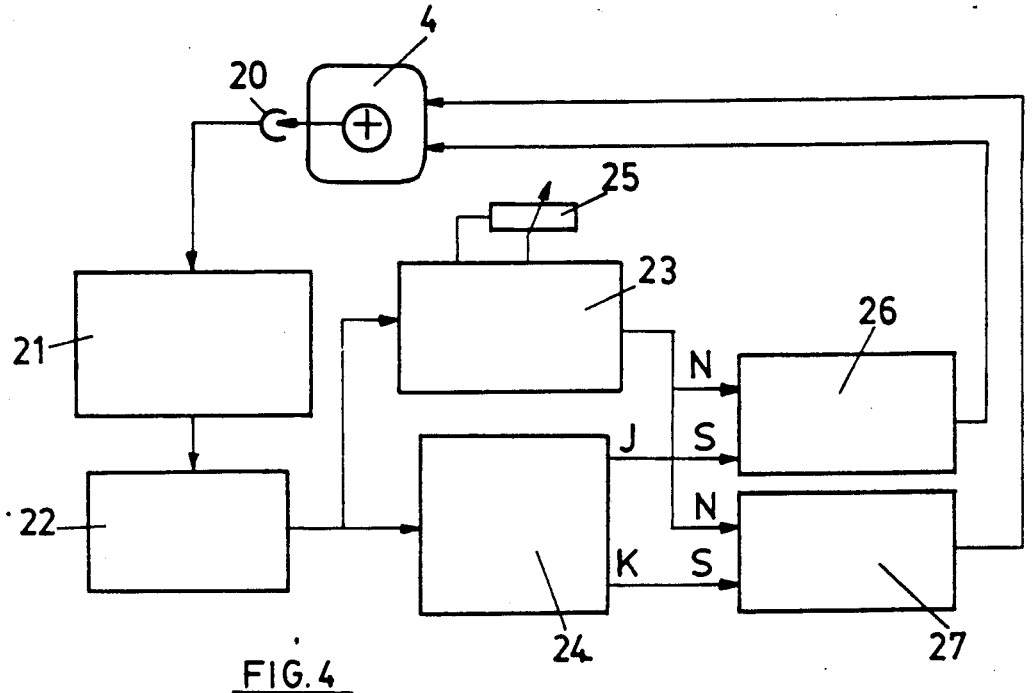
FIG. 4 is a circuit diagram of an electronic controller of a motor, the essential function of which is to emulate human impulsion, taking advantage to the maximum of the energy of the motor.

FIG. 4 shows a diagram of an electronic controller of the activating motor of the fan. In any moving part of the assembly, but preferably in the pulley of the motor, is positioned an activity sensor 20 which can be inductive, an electric generator, optic or capacitative. The signal delivered by the activity sensor 20 passes through an amplifier 21 to an integrator circuit 22, at the outlet of which will be generated a signal each time sensor 20 detects that the motor is stopped. This signal is applied to a monostable circuit 23 of the "one-shot" type and to a bistable circuit 24 of the "flip-flop" type. Each time the integrator 22 outputs a signal, the monostable circuit 23 will output through an outlet a variable-duration signal, adjustable as a function of the position of a potentiometer 25 thereof. Also, each time the integrator 22 outputs a signal, the status of outlets J and K of bistable circuit 24, which are opposite each other, will change. That is, when there is emission of a signal from one outlet there will not be a signal from the other.

Finally, there are two driver circuits 26, 27 for the motor 4, one for each direction of turn, and each having two inputs, one an enabler S connected to one of the outlets of the bistable circuit 24, and the other an inhibitor N connected to the outlet of the monostable circuit 23.

To start operation of the fan, upon the fan leaving a position of repose, when energy is applied to the assembly, the motor will turn in one of two opposite directions, depending on the state of the bistable circuit 24, i.e. which driver 26 or 27 has the enabler S thereof connected to the respective outlet of circuit 24. Although at this time it may not be relevant, the activity sensor 20 will arm the integrator circuit 22 by detecting that the motor is turning.

By means of the transmission assembly, the fan member will begin its ascent in the corresponding direction. During such ascent the force of the motor will become balanced by the weight of the fan, and this will cause the fan to stop. At the instant of such stopping, the activity sensor 20 will apply a signal to the amplifier 21 and therefore the integrator 22 will output a signal that will cause firing of the monostable circuit 23 and also will cause a change of status of the "flip-flop" bistable circuit 24. The change of status of the bistable circuit 24 will enable conduction of that driver which has not been operating up to that time. This will reverse the direction of rotation of the motor and consequently the oscillation of the fan member, which this time will reach a further or maximum height, since the energy of weight accumulated in the fan member from the previous stroke will be added to the force of the motor during the new stroke.

During the first oscillating strokes of the fan member, the angle of ascension thereof will increase until there is reached an equilibrium between the maximum force of the motor (which as already mentioned will be or should be limited), and the weight of the fan member. For each stroke, a greater force will be necessary to elevate the fan member a little higher, since the cosine of the angle formed between the fan member and the horizontal increases rapidly.

An explanation of the functions of the monostable circuit 23 follows. As indicated above, each time the motor stops, besides a change in status of the bistable circuit 24, a discharge of the monostable circuit occurs. This will inhibit that driver that was just previously enabled by the bistable circuit, until the signal from the monostable circuit to the inhibitor N entry of such driver is stopped. This provides two functions. On the one hand, the change of direction of the fan member is achieved in a smooth and therefore harmonic fashion, the motor not being subject to sudden change of direction. On the other hand, depending on how long the inhibitor signal coming from the monostable circuit lasts, which length of time is regulated by the potentiometer 25, the time of each stroke of the fan member, which will be applying energy to the motor, will be greater or less. This makes it possible to obtain a greater or lesser degree of elevation of the fan member, and therefore the fanning motion can be regulated.

In order to avoid a possible unpriming of the operating cycle, as would occur if accidentally or intentionally the fan member were to be retained in a position close to that of repose, the integrator circuit 22 can have associated with it an oscillator which will provide impulses at a frequency slighter more than double that of the natural oscillation of the fan, during all times the activity detector detects that the motor is stopped. In this way, the motor will be trying to turn alternately in opposite directions until the retention of the fan member ceases. A good precautionary measure is the inclusion of a thermal and fusible circuit breaker which cuts the power before an elevation of temperature in the motor winding occurs due to too long a retention of the fan member or any other anomaly.

I claim:

1. An electric ceiling fan comprising:

a support member to be mounted on a ceiling or on a ceiling beam;

a reversible electric motor mounted on said support member and having an output shaft rotatable in opposite directions;

a speed reduction system, coupled to said output shaft, for imparting to at least one arm member a reduced speed oscillating motion;

a planar shaped fan member suspended from said at least one arm member for oscillating pendulum fanning motion thereby in opposite directions; and electronic control means, operatively connected to said motor, for controlling operation thereof in opposite directions as a function of the pendulum motion of said fan member.

2. A fan as claimed in claim 1, comprising two said arm members.

3. A fan as claimed in claim 1, wherein said speed reduction system includes an output axle, and said arm is suspended in pendulum fashion from said output axle.

4. A fan as claimed in claim 1, wherein said arm is suspended in pendulum fashion from an axle, and said speed reduction system is coupled to said arm to swing said arm in opposite directions about said axle.

5. A fan as claimed in claim 1, wherein at the upper limit of each pendulum motion of said fan member, the weight of said fan member overcomes the force of said motor driving said fan member and thereby stops rotation of said output shaft of said motor, and said control means comprises means for detecting such stopping of said output shaft and for reversing the direction of rotation thereof in response to such detection.

* * * * *